US006883434B2

(12) United States Patent
Kienzler et al.

(10) Patent No.: US 6,883,434 B2
(45) Date of Patent: Apr. 26, 2005

(54) FUSE DEVICE FOR A PROJECTILE

(75) Inventors: Frank Kienzler, Villengen-Schwenningen (DE); Wolfgang Schillinger, Schiltach (DE); Wolfgang Zehnder, Schramberg (DE)

(73) Assignee: Junghans Feinwerktechnik GmbH & Co. KG, Scramberg (DE)

( * ) Notice: Subject to any disclaimer, the term of this patent is extended or adjusted under 35 U.S.C. 154(b) by 0 days.

(21) Appl. No.: 10/662,359

(22) Filed: Sep. 16, 2003

(65) Prior Publication Data

US 2004/0144278 A1 Jul. 29, 2004

Related U.S. Application Data

(63) Continuation-in-part of application No. 09/953,220, filed on Sep. 17, 2001, now abandoned.

(51) Int. Cl.[7] ..... F41C 15/00
(52) U.S. Cl. ..... 102/221
(58) Field of Search ..... 102/221, 223, 102/231, 264

(56) References Cited

U.S. PATENT DOCUMENTS

| | | | | |
|---|---|---|---|---|
| 3,094,932 A | | 6/1963 | Greenlees | |
| 3,294,021 A | | 12/1966 | Stutz | |
| 3,343,490 A | | 9/1967 | Barrett | |
| 3,839,984 A | | 10/1974 | Hinves et al. | |
| 4,286,521 A | * | 9/1981 | Marer | 102/200 |
| 4,489,654 A | * | 12/1984 | Van Sloun et al. | 102/204 |
| 4,765,245 A | * | 8/1988 | Berube et al. | 102/251 |
| 5,016,532 A | | 5/1991 | Edminster | |
| 5,296,223 A | * | 3/1994 | Nakanishi et al. | 424/94.64 |
| 5,485,788 A | | 1/1996 | Corney | |
| 5,591,935 A | * | 1/1997 | Shamblen et al. | 102/500 |
| 5,612,505 A | * | 3/1997 | O'Brasky et al. | 102/268 |
| 6,463,855 B1 | * | 10/2002 | Zehnder et al. | 102/223 |
| 2002/0033110 A1 | * | 3/2002 | Kienzler et al. | 102/264 |

FOREIGN PATENT DOCUMENTS

| | | | | |
|---|---|---|---|---|
| DE | 10043581 A1 | * | 3/2002 | F42C/19/06 |

* cited by examiner

*Primary Examiner*—Michael J. Carone
*Assistant Examiner*—Troy Chambers
(74) *Attorney, Agent, or Firm*—Burns, Doane, Swecker & Mathis, L.L.P.

(57) ABSTRACT

A mortar includes a fuse device having a detonator, and a firing booster arranged to be ignited in response to detonation of the detonator. The detonator is detonated by a firing pin. Advancement of the firing pin toward the detonator is effected by an electrically ignitable pyrotechnic charge.

4 Claims, 2 Drawing Sheets

FUSE DEVICE FOR A PROJECTILE

This application is a Continuation-in-Part of U.S. Ser. No. 09/953,220 filed Sep. 17, 2001, now abandoned the entire content of which is hereby incorporated by reference.

BACKGROUND OF THE INVENTION

The invention concerns a fuse device for a projectile, such as a mortar. The fuse device comprises a firing pin, an initiating detonator to be ignited by the firing pin, and a firing booster arranged to be ignited by the initiating detonator, which are arranged in a firing chain.

Fuse devices of that kind are known in various different design configurations. For example, see the configuration disclosed in copending U.S. Ser. No. 09/754,208 filed Jan. 5, 2001, now U.S. Pat. No. 6,463,855 issued on Oct. 15, 2002, the disclosure of which is incorporated by reference herein.

The object of the present invention is to provide a fuse device of that general kind which is of a comparatively simple design and which has a high level of operational reliability.

SUMMARY OF THE INVENTION

In accordance with the invention, that object is attained in that the firing pin is integrated into an electrical force element.

Besides the advantages of a high level of operational reliability combined with a saving on component parts, the fuse device according to the invention also enjoys the advantage that it can be used for all electrical fuses.

By virtue of the fact that, with the fuse device according to the invention, the electrical and mechanical firing functions are combined together in a firing chain, it is possible that the fuse device according to the invention to be used instead of an electrical primer or percussion cap or detonator.

BRIEF DESCRIPTION OF THE DRAWINGS

The objects and advantages of the invention will become apparent from the following detailed description of a preferred embodiment thereof in connection with the accompanying drawing in which like numerals designate like elements, and in which.

DESCRIPTION OF A PREFERRED EMBODIMENT OF THE INVENTION

Figure 1:
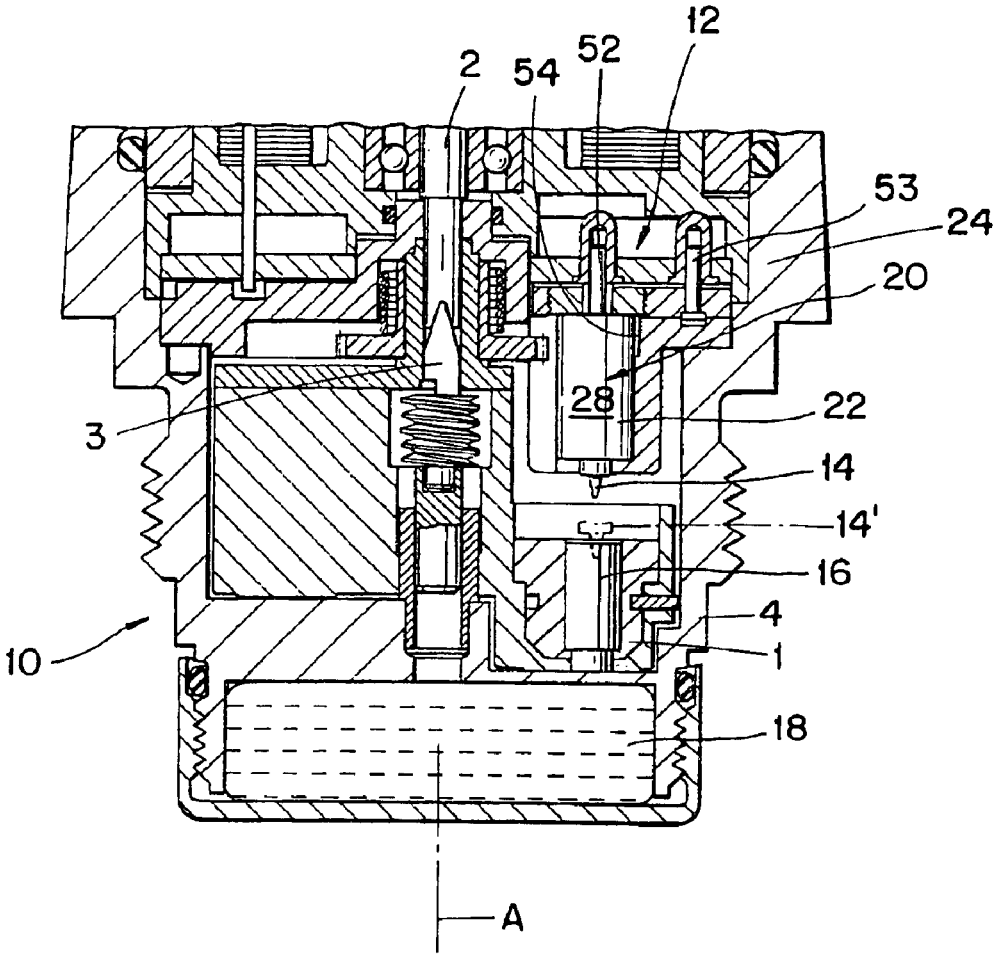
FIG. 1 is a view in longitudinal section of a portion of a projectile containing a fuse device according to the invention.

In FIG. 1 there is shown a view in longitudinal section of a part of a projectile 10 in which a fuse device 12 is disposed. The projectile 10 is preferably a mortar. The fuse device is similar to that described in earlier-mentioned U.S. Pat. No. 6,463,855 in that an initiating detonator is mounted in a housing 1 which is rotatable within a casing 4 about an axis A. Rotation of the housing 1 occurs following a launching of the mortar, and the rotational drive is supplied by a shaft

2 that is connected to a worm 3 disposed on the axis A. Details of how the rotation of the worm 3 is transmitted to the housing are not part of the present invention, but may be found in the above-referenced U.S. Pat. No. 6,463,855.

Rotation of the housing causes the initiating detonator 1 to be displaced from the inactive position into an active position (depicted) wherein one side thereof faces a firing pin 14, and an opposite side thereof faces a firing booster 18. Accordingly, by actuating the firing pin 14, the detonator will detonate and ignite the booster 18.

In FIG. 1, the firing pin 14 is illustrated in the safe position. Reference numeral 14' indicates the firing pin in its ignition position (illustrated by dotted lines) penetrating the metal housing of the initiating detonator 16 and igniting the initiating detonator 16. That is, a pressure-sensitive, mechanically ignitable primer charge of the initiating detonator 16 is ignited by the kinetic energy (momentum) of the firing pin 14.

In accordance with one aspect of the present invention, the firing pin is actuated electrically in response to a signal received, via connector 24, from a suitable electric firing system within the fuse device, e.g., a proximity fuse (not shown). The firing pin itself constitutes a slidable part of a power element 20, such as an electric solenoid mechanism, which displaces the firing pin by electromagnetic force. The solenoid mechanism comprises a cylinder 22 in which the firing pin 14 slides. An electric coil (not shown) is disposed in the cylinder which creates a magnetic field when energized. The firing pin could be magnetized, or attached to a magnetized component, such as a piston, whereby the firing pin is caused to slide in either direction, depending upon the direction of electric current in the coil. When caused to slide toward the detonator 16, it will cause the detonator to detonate and ignite the booster 18.

FIG. 2 through FIG. 5 show, in schematic illustration, a type of firing pin mechanism employing electric ignitable power elements and axially displaceable pistons as firing pins.

Figure 2:
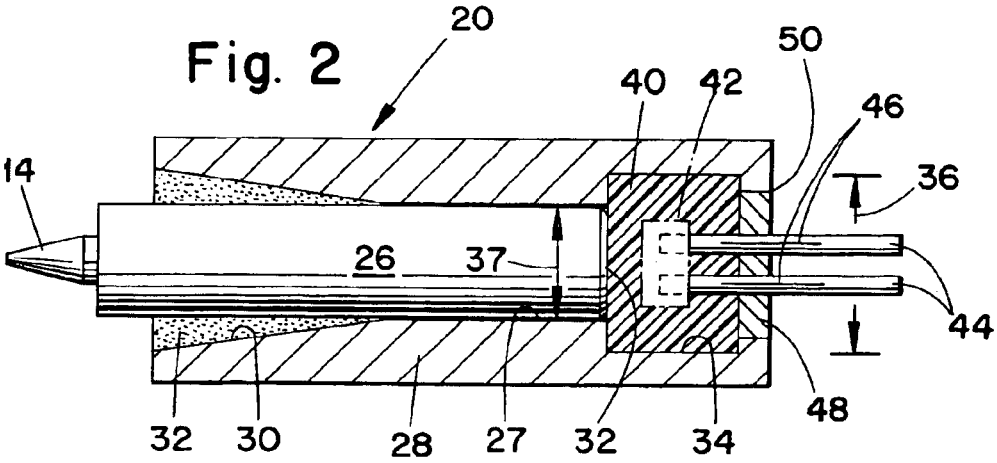
FIG. 2 is a longitudinal sectional view through the firing pin and an electrically ignitable pyrotechnical charge therefor.

As shown in FIG. 2 the firing pin 14 is a part of a cylindrical piston 26. The piston 26 rests in an opening formed by a housing 28. In particular, a rear portion of the piston is disposed in a rear cylindrical bore 27 of the opening. A conical front mouth 30 of the opening communicates with the bore 27 and is filled with a foam-like synthetic material 32 which adheres to the piston 26 as well as to the wall of the mouth 30, so that the piston 26 is secured in the housing 28 in the illustrated safe position.

A chamber 34 is disposed in the housing 28 directly at the bottom or rear end 33 of the piston 26. The diameter 36 of the chamber 34 is larger than the diameter 37 of the bore 27. The chamber 34 contains an electric ignitable pyrotechnic charge 40, a bridge primer 42 (illustrated by dotted lines), and two electric pole pins 44 having electric insulated conductors 46 embedded therein. The conductors are illustrated only in a schematic manner. The pole pins 44 are fastened to a metal disk 48 which is welded around its circumference to a rear end 50 of the housing 28.

The piston 26 together with its firing pin 14, the housing 28, and the metal disk 48 are all made of steel.

Instead of providing two electric pole pins 44 arranged directly in the power element 20 as shown in FIG. 2, there could be provided a center pole pin 52 which leads into the center of the power element 20, and a second pole pin 53 which operatively connects the power element 20 to the electric mass of the primer 10 via a contact tab 54 as shown in FIG. 1. The contact tab 54 makes contact at the circumference of the housing 28.

Figure 3:
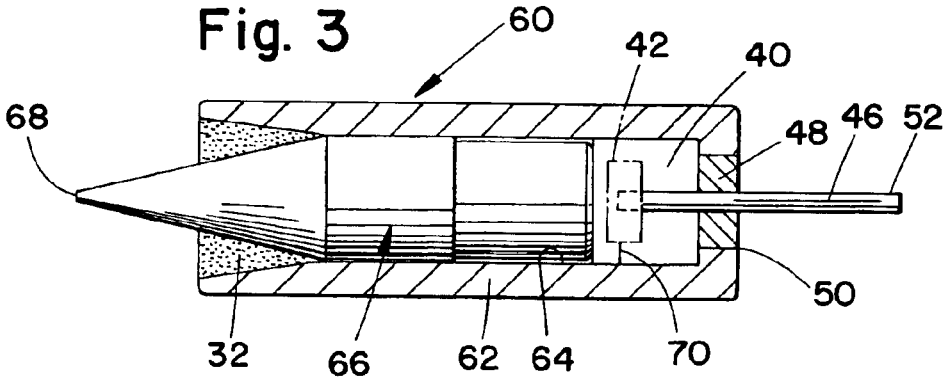
FIG. 3 is a view similar to FIG. 2 showing an alternate piston shape and electrical supply.

In FIG. 3 the power element is designated by numeral 60. The projecting electric contact is provided in that power element 60. Like numerals designate equally-functioning characteristics of the power elements 20 according to FIG. 2 and the power element 60 according to FIG. 3.

According to FIG. 3, the housing 62 is provided with a through-going bore 64 for a piston 66 having a firing point 68 and having a bridge primer 42 for the pyrotechnic charge 40. The bridge primer 42 is electrically coupled to the housing 62 via a conductor 70.

Figure 4:
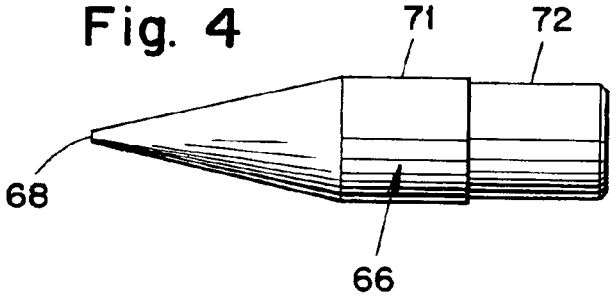
FIG. 4 depicts the piston of FIG. 3.

FIG. 4 shows the piston 66. A mid-section 71 of the piston 66 is a little larger in diameter than the shank 72 at the rear thereof, whereby the section 71 guides the piston 66 in the bore 64.

Figure 5:
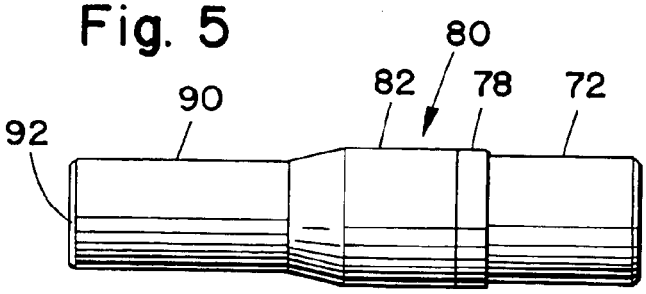
FIG. 5 depicts another piston shape.

FIG. 5 shows an alterative piston structure, wherein a piston 80 is guided in the bore 64 of the housing 62 by a very narrow segment 78 which lies between the shank 72 and the segment 82. The segment 82 has a diameter 84 that is only slightly smaller than the diameter 86 of the segment 78. According to FIG. 5, a pin 90 with a blunt front nose formed by a plane face 92 is provided on the piston 80 in place of the firing point 68 in FIG. 4 that has a generally pointed nose.

It will be appreciated that the power element 20 is of simple construction and formed of few components. It exhibits a high degree of ruggedness and reliability. Moreover, it can be used in all electric fuses. Since the electrical activating force also creates the mechanical (i.e., electromagnetic) firing pin-thrusting force, the fuse can replace an electric primer or percussion cap detonator.

Although the invention has been described in connection with a preferred embodiment thereof, it will be appreciated by those skilled in the art that additions, modifications, substitutions and deletions not specifically described may be made without departing from the spirit and scope of the invention as defined in the appended claims.

What is claimed is:

1. A fuse device comprising:

a casing;

an initiating detonator disposed in the casing;

a firing booster arranged to be ignited in response to detonation of the initiating detonator; and an electrically actuated power device for detonating the initiating detonator, comprising:

a housing forming an opening which includes a rear cylindrical bore and a front generally conical mouth;

a piston slidably disposed in the opening such that a rear portion of the piston is disposed in the rear cylindrical bore, and a front portion of the piston is disposed in the generally conical mouth, an electrically ignitable pyrotechnic charge disposed in the opening adjacent a rear end of the piston for advancing the piston toward the initiating detonator, and a synthetic foam material disposed in the mouth to adhere the piston to the housing.

2. The fuse device according top claim 1 further including a bridge primer disposed in the pyrotechnic charge, and connected to an electrical source.

3. The fuse device according to claim 1 wherein a front nose portion of the piston is generally pointed.

4. The fuse device according to claim 1 wherein a front nose portion of the piston is blunt.

* * * * *